US006135069A

United States Patent [19]

Fenelon et al.

[11] Patent Number: 6,135,069

[45] Date of Patent: Oct. 24, 2000

[54] METHOD FOR OPERATION OF A FREE PISTON ENGINE

[75] Inventors: Thomas R. Fenelon; John M. Clarke, both of Chillicothe, Ill.

[73] Assignee: Caterpillar Inc., Peoria, Ill.

[21] Appl. No.: 09/151,267

[22] Filed: Sep. 11, 1998

[51] Int. Cl.[7] ..... F02B 71/00

[52] U.S. Cl. ..... 123/46 R

[58] Field of Search ..... 123/46 R, 46.5 C

[56] References Cited

U.S. PATENT DOCUMENTS

| | | | |
|---|---|---|---|
| 2,333,419 | 11/1943 | Fitch | 123/7 |
| 2,463,051 | 3/1949 | Pescara | 60/13 |
| 2,666,569 | 1/1954 | Bent | 123/46 R |
| 2,671,435 | 3/1954 | Spier et al. | 123/46 R |
| 3,046,958 | 7/1962 | Bard et al. | 123/7 |
| 3,297,007 | 1/1967 | Monpetit | 123/46 R |
| 3,335,640 | 8/1967 | Conrad | 123/46 R |
| 3,606,591 | 9/1971 | Potma | 417/364 |
| 3,769,950 | 11/1973 | Braun . | |
| 3,853,100 | 12/1974 | Braun | 123/46 R |
| 4,403,474 | 9/1983 | Ruthven | 60/396 |
| 4,480,611 | 11/1984 | Wendt | 123/197 C |
| 4,599,861 | 7/1986 | Beaumont | 60/595 |
| 4,705,460 | 11/1987 | Braun | 417/266 |
| 4,920,928 | 5/1990 | Hammett | 123/46 SC |
| 5,473,893 | 12/1995 | Achten et al. | 60/413 |
| 5,482,445 | 1/1996 | Achten et al. | 417/362 |
| 5,540,194 | 7/1996 | Adams | 123/46 R |

FOREIGN PATENT DOCUMENTS

| | | |
|---|---|---|
| 0 481 690 A2 | 4/1992 | European Pat. Off. . |
| WO 93/10345 | 5/1993 | WIPO . |
| WO 96/00342 | 1/1996 | WIPO . |
| 97/14786 | 8/1997 | WIPO . |

*Primary Examiner*—Willis R. Wolfe
*Assistant Examiner*—Jason Benton
*Attorney, Agent, or Firm*—Alan J. Hickman

[57] ABSTRACT

Method for operating a free-piston engine to produce relatively low amounts of undesirable NOx by initiating injection of the atomized fuel mixture into the combustion chamber after closure of exhaust apertures by the combustion chamber piston during the compression stroke thereof to attain a homogeneous fuel-air mixture and relatively lower and more uniform local combustion flame temperature in the combustion chamber.

4 Claims, 1 Drawing Sheet

METHOD FOR OPERATION OF A FREE PISTON ENGINE

TECHNICAL FIELD

The present invention relates to internal combustion engines and more particularly to a method for operating a free piston-type internal combustion engines in such a manner as to provide for low NOx production.

BACKGROUND ART

Free piston engines are utilized to convert chemical energy to hydro-mechanical energy. This type of engine, for example, when designed to operate on hydrocarbon fuels such as diesel grade fuel oils, include a piston adapted to slidingly linearly reciprocate within a combustion cylinder provided with an intake air aperture, an exhaust air aperture, and a fuel injection device. The piston is connected to a piston shaft extending from the piston through the combustion cylinder wall along the axis of movement of the piston. The piston shaft is typically connected to a return piston operating coaxially with the combustion cylinder piston in a compression chamber. The return piston slidably linearly reciprocates in the compression chamber under the influence of a compression device, so as to ensure the action of the combustion cylinder piston. A frequency control device, either of a hydraulic or electronic nature, is typically provided to control the action of the return piston and thereby control the speed of operation of the free piston engine. The piston shaft is further typically connected to linearly operate a plunger reciprocally in a power chamber. Such a plunger is, for example, suitable for use as a fluid pump for the compression of hydraulic fluid, as an air compressor, or another similar device.

In operation, the piston moves within the combustion cylinder between a top dead center position which is the position which provides the minimum volume of the combustion chamber defined by the piston and combustion cylinder, and the bottom dead center position at which the combustion chamber is at its maximum volume. During a typical two-cycle operation, the compression device is actuated to provide pressure on the compression piston and act upon the combustion cylinder piston through the piston connecting rod to drive the combustion cylinder piston toward the top dead center position. As the piston approaches the top dead center position, the fuel injector is actuated to spray a quantity of fuel into the combustion chamber. Because of the relatively high compression caused by the piston within the combustion chamber, the fuel-air mixture then auto-ignites, causing the combustion cylinder piston to subsequently reverse its direction and move toward the bottom dead center position. A portion of the energy thus released by the fuel-air mixture combustion is recaptured in the return piston actuator device. However, the majority of the energy thus released is transmitted through the piston connecting rod to the plunger and thus to the fluid upon which the plunger acts. As the piston continues to move toward bottom dead center, the piston moves to open the exhaust aperture and the intake air apertures to permit the flow of exhaust gases from the combustion chamber and to permit a new inflow of intake air to be used in the succeeding engine cycle.

One primary disadvantage of the two-cycle free piston type engine, according to the prior art, has been the undesirable production of exhaust gas by-products such as NOx. Another undesirable feature of the two-cycle internal combustion engine has typically been the emission of undesirable quantities of unburned hydrocarbons. Many legal jurisdictions now regulate the various emissions and have established laws and regulations which provide legal sanction for the operation of engines with emissions in excess of the allowable standards. Also, some jurisdictions disallow the operation of such engines until modifications or repairs have been completed thereon. Therefore, it is desirable to improve the performance of internal combustion engines in this respect.

It is well known, that the production of NOx increases as a function of the local flame temperature of the air-fuel mixture during combustion thereof. Excessively high local flame temperature is typically a function of a failure to provide an adequate mixture of the air and fuel prior to combustion. However, injection of atomized fuel into the combustion chamber requires a finite time period for the delivery of the desired fuel volume, just as the entry of intake air and expunging of exhaust by-products requires a finite time period. The operating method according to the prior art typically provides only a short space of time for fuel-air mixing. When the air-fuel mixture is inadequately mixed, the proportion of unburned hydrocarbon likewise tends to increase due to the irregularity of the flame temperature through the combustion chamber.

It is therefore desirable to reduce the production of undesirable emission by-products in a free piston-type internal combustion engine with out adversely affecting the performance of the engine in which it is employed.

It is also desirable to reduce the production of undesirable emission by-products by providing a lower and more uniform local flame temperature in the combustion chamber of the engine in which it is employed.

It is also desirable to reduce the production of undesirable emission by-products without adding components or making modifications to the free piston engine.

The present invention is directed to overcoming one or more of the problems set forth above.

SUMMARY OF THE INVENTION

In one aspect of the present invention, a method for operating a free-piston engine apparatus having a combustion chamber body, a compression section, and a piston element. The piston element having a piston head in said combustion chamber body. An exhaust passage is disposed in the combustion body, and a compression chamber piston is disposed in the compression section. The piston element is reciprocally movable in the engine. The method includes providing a control valve in flow communication with the compression section, providing a fuel injection device which selectively injects atomized fuel into the combustion chamber body to in the engine, providing a controller in communication with the control valve and the fuel injection device, said controller actuating the control valve and the fuel injection device, and actuating the control valve prior to actuating fuel injection device with the controller.

In another aspect of the present invention a method of providing a homogeneous fuel-air mixture in a free-piston engine apparatus having a combustion chamber body and a compression section, a piston element for reciprocal operation in the engine including a piston head in said combustion chamber body and a compression chamber piston in said compression section, a control valve in flow communication with the compression section, a fuel injection device being selectively actuatable to inject atomized fuel into the combustion chamber body, and a controller in communication with the control valve and the fuel injection device. The controller being adapted for actuating the control valve and the fuel injection device. The method comprising the steps of actuating the control valve to reciprocate said piston element from a bottom dead center BDC position to a top dead center TDC position through a stroke "S", and actuating the fuel injection device, during the stroke "S", at a location of the piston element between the top dead center TDC position and the bottom dead center BDC at which the piston element closes the exhaust aperture.

DESCRIPTION OF THE PREFERRED EMBODIMENT

Figure 1:
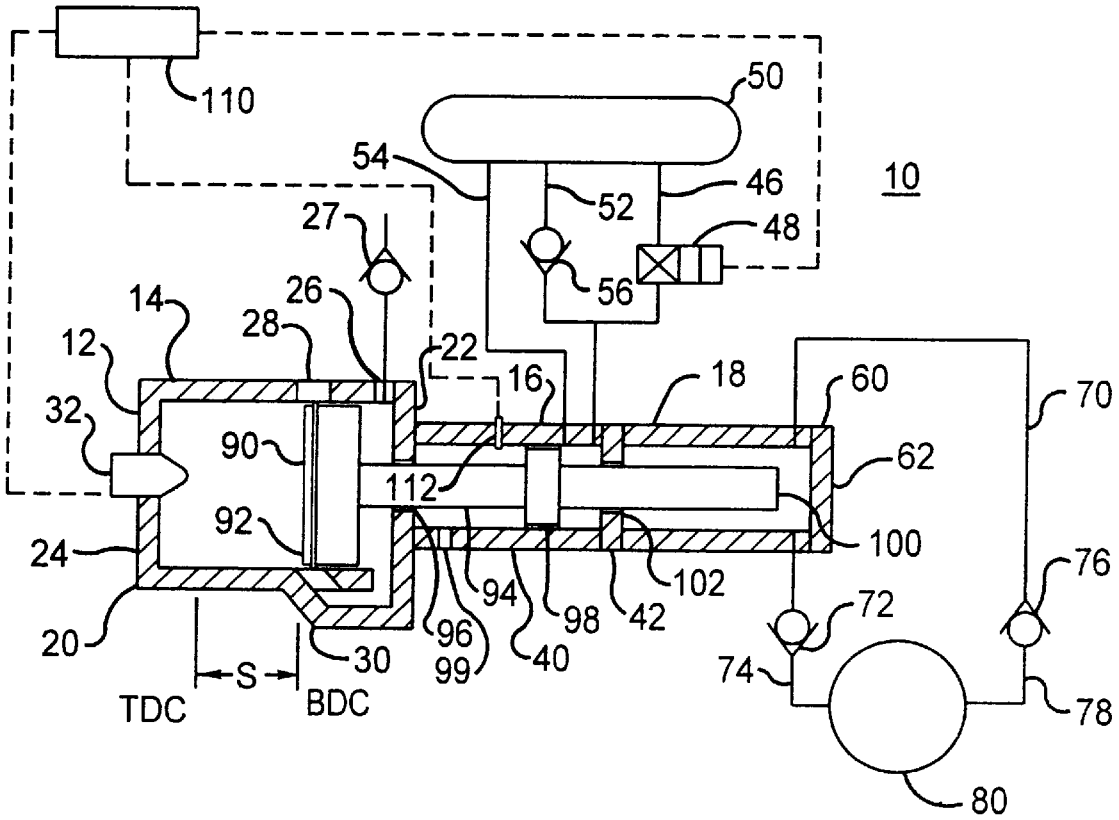
FIG. 1 is a diagrammatic cross-sectional view of a typical free piston engine apparatus including the present invention.

FIG. 1, the sole FIGURE, shows a representative single-cylinder free piston engine 10 apparatus in a cross-sectional view. The free piston engine apparatus 10 is to be understood by those skilled in the art as representative and exemplary of free piston engines generally in which the subject invention may be applied, and therefore is not to be taken as limiting the use of the present invention to any specific free piston engine apparatus. The subject invention may be applied as well to each of the cylinders in a dual-cylinder engine apparatus, for example.

The engine apparatus 10 has an engine block 12 which includes three co-axial sections defining work spaces therein, including a first engine section 14, a second compression section 16, and a third power section 18.

The first engine section 14 includes a relatively larger diameter tubular combustion chamber body 20, a combustion chamber baseplate 22 on the proximate end of the combustion chamber body 20, and a combustion chamber head 24 on the distal end of the combustion chamber body 20. The combustion chamber body 20 also includes and defines an intake aperture 26 connected to a check valve 27 for permitting intake air to flow only into the combustion chamber adjacent the combustion chamber baseplate 22, and an exhaust aperture 28 disposed between the baseplate 22 and head 24 for permitting exhaust by-products to escape from the combustion chamber. The combustion chamber body 20 also includes an intake bypass passageway 30 for permitting intake air to flow from adjacent the baseplate 22 toward the head 24. A fuel injection device 32 is disposed in the combustion chamber head 24 for providing controlled fuel injection into the combustion chamber.

The second compression section 16 includes a tubular compression chamber body 40 extending from the combustion chamber baseplate 22 to a partition plate 42. The compression chamber body 40 is in flow connection with a first control line 46 in which is disposed a selectively operable control valve 48 which selectively permits and alternatively prevents a flow of fluid through the first control line 46 and into the compression chamber body 40. The first control line 46 is flowably connected to a control accumulator 50 for receiving a flow of pressurized fluid therefrom. The control accumulator 50 is in further flow connection with a second control line 52 and a third control line 54 for receiving flow from the compression chamber body 40. As with the first control line 46, the second control line 52 is in flow connection with the work space in the compression chamber body 40, and includes a control check valve 56 therein for permitting a flow through the second control line 52 to the accumulator 50 from the first aperture 44, while preventing a flow from the accumulator 50 to the compression chamber body 40. The third control line 54 is flowably connected to the compression chamber body 40 for permitting a flow to and from the control accumulator 50.

The third power section 18 includes a tubular power section body 60 with an endplate 62 for providing an enclosed power chamber. A power takeoff device 70 is in fluid flow connection with the power section body 60. The power takeoff device 70 includes an inlet check valve 72 disposed in a return line 74 and an outlet check valve 76 disposed in a power line 78. The power line 78 is flowably connected to a hydraulic load 80 which in turn is connected to the return line 74. The power takeoff device 70 will be understood by those skilled in the art as exemplary, and not to be taken as limiting, as there is a large variety of different types of applications and load which may be powered by the engine apparatus 10.

A piston element 90 is disposed co-axially within the engine block 12. The piston element 90 includes a cylindrical piston head 92 operably disposed within the combustion chamber body 20 so as to permit linear sliding motion between the compression chamber baseplate 22 and the compression chamber head 24. A relatively small diameter cylindrical piston rod 94 is co-axially connected to the piston head 92, extending through a piston rod aperture 96 in the combustion chamber baseplate 22. Piston rod 94 is operably connected to a compression chamber piston 98 slidably disposed for linear operation in the compression chamber body 40. A vent aperture 99 is provided in the compression chamber body to facilitate expelling entrapped fluid therefrom during a compression stroke of the piston head 92. Finally, a power displacement piston 100 extends from the compression chamber piston 98 opposite to and co-axially with the piston rod 94 into the power section body 60 through a partition plate aperture 102.

A controller 110 is provided for controlling the operation of the free piston engine 10. The controller 110 is in communication with the control valve 48 and with the fuel injection device 32, and can selectively actuate the control valve 48 and the fuel injection device 32. This enables the controllers 110 to control the timing of the injection of fuel into the combustion chamber by controlling both the actuation of the fuel injection device 32 and the control valve 48.

A piston element position sensor 112 is connected in signal communication with the controller 110 and mounted on the second compression section 16. The sensor 112 senses the position of the piston element 90 and delivers a responsive position signal to the controller 110. Exhaust aperture 28 closure is directly related to piston element 90 position. The controller 110 utilizes this position information during the controlling of the fuel injection device 32, and the control valve 48. Fuel injector device 32 actuation is controlled to occur after closure of the exhaust aperture based on the position signal.

Industrial Applicability

With reference to FIG. 1, and in operation, the combustion chamber is that space defined within the combustion chamber body 20 between the piston head 92 and the compression chamber head 24. The piston element 90 operates through a stroke S of a length determined by the length of the compression chamber body 40 less the axial length of the compression chamber piston 98. The compression chamber piston 98 is near the partition plate 42, the piston head 92 is farthest removed from the combustion chamber head 24, which is the maximum combustion chamber volume and also the bottom dead center BDC position. When the compression chamber piston 98 is near the combustion chamber baseplate 22, the piston head 92 is in the top dead center TDC and the combustion chamber volume is at its minimum.

To initiate the operation of the engine apparatus 10, the control valve 48 is actuated to the flow position by the controller 110 to permit flow from the control accumulator 50 through the first control line 46 into the compression chamber body 40 so that the fluid acts on the compression chamber piston 98. This in turn drives the piston element 90 from the BDC position toward the TDC position, opening the third control line 54 to further discharge the accumulator 50 while simultaneously accelerating the piston, closing the exhaust aperture 28 and intake bypass passageway 30 so as to close the combustion chamber and cause compression of the gases therein. At or near the TDC position, the air fuel mixture compressed within the combustion chamber ignites, forcing the piston head 92 toward the BDC position. This action drives fluid from the compression chamber body 40 through the second control line 52 and the third control line 54 back into the accumulator 50 to complete recharging thereof, and also causes the power displacement piston 100 to displace fluid from the power section body 60 into the power line 78 to actuate the power takeoff device 70. Furthermore, as the piston element 90 travels toward the TDC position, air is drawn through the check valve 27 into the void between the piston head 92 and the combustion chamber baseplate 22 to be pre-compressed prior to passing through the intake bypass passageway 30 to enter the combustion chamber.

As the piston element 90 reaches the BDC position, and after a delay time at BDC, the controller 110 actuates the control valve 48 to initiate another stroke "S" to the TDC position. The control valve 48 is actuated prior to actuation of the fuel injection device with the controller 110. Subsequently, the fuel injection device 32 is actuated by the controller 110 to initiate a spray of atomized fuel particles into the combustion chamber. Preferably, the fuel injection device 32 is actuated by the controller 110 during the duration of the stroke from the time the exhaust aperture closes. This actuation begins when piston 90 closes the exhaust aperture 28. Closure of the exhaust aperture 28 is determined by the controller 110 based on a signal received from the piston element position sensor 112. This relatively long duration of fuel-air mixing time, as the piston moves between exhaust aperture 28 closure and top dead center TDC, creates a highly homogeneous fuel-air mixture. As the piston head 92 approaches the TDC position, the fuel-air mixture auto-ignites resulting in a relatively low local combustion flame temperature with relatively few areas of undesirably high local flame temperature, which results in a relatively low production of NOx. This method is then repeated for each two-stroke cycle of the engine apparatus 10.

Advantages of the operation of the engine apparatus 10 are readily apparent. The improved homogeneity of the fuel-air mixture reduces the likelihood of unmixed, unburned fuel particles being released in the exhaust by-products, providing greater operating efficiency in terms of specific power generation and consequently in reduced fuel consumption. Furthermore, the improved homogeneity of the fuel-air mixture results in a lower and more uniform local combustion flame temperature, which inhibits and reduces the production of undesirable pollutants such as NOx. Also, the operating life of the engine apparatus 10 is extended by the reduction of the local combustion flame temperatures, as there is a reduced likelihood of the development of hot spots which can damage the engine apparatus 10 and increase the maintenance requirements of the engine apparatus 10.

The improved operating method according to the present invention is also readily and easily applied to and implemented in the typical free piston engine, with no requirement for additional components or other undesirable initial or operating costs imposed. These and other advantages of the present invention will be readily apparent to those skilled in the art. Therefore, it can be seen that the present invention presents substantial improvements over the prior art.

Modifications to the preferred embodiment of the subject invention will be apparent to those skilled in the art within the scope of the claims that follow.

What is claimed is:

1. A method of operating a free-piston engine apparatus comprising the steps of:

providing a free-piston engine apparatus with a combustion chamber body and a compression section;

providing in said engine a piston element including a piston head in said combustion chamber body, and exhaust passage in said combustion chamber body, and a compression chamber piston in said compression section, said piston element being reciprocally movable in said engine between a bottom dead center position BDC and a top dead center position TDC, said exhaust passage being located between said bottom dead center position BDC and said top dead center position TDC, said piston element being movable to close said exhaust passage;

providing a control valve in flow communication with said compression section;

providing a fuel injection device in said engine, said fuel injecting device selectively injecting atomized fuel into said combustion chamber body;

providing a controller in communication with said control valve and said fuel injection device, said controller actuating said control valve and said fuel injection device;

actuating said control valve prior to said fuel injection device with the controller and passing fluid to said compression section, said fluid moving said piston element from the bottom dead center BDC position to the top dead center position; and actuating said fuel injection device immediately after a closing of the exhaust aperture with the engine piston element and continuously during movement of the engine piston element through a stroke "S" substantially to the top dead center position TDC.

2. The method of operating the free piston engine apparatus, as set forth in claim 1, wherein said free piston engine apparatus includes a piston element position sensor connected to the controller, said piston element head being movable to close said exhaust aperture, including the steps of:

sensing a position of the piston element and delivering a signal to the controller; and actuating said fuel injection device after a closing of the exhaust aperture by said piston element and in response to receiving a signal from said controller.

3. A method of providing a homogeneous fuel-air mixture in a free-piston engine apparatus having a combustion chamber body and a compression section, a piston element for reciprocal operation in said engine including a piston head in said combustion chamber body and a compression chamber piston in said compression section, a control valve in flow communication with said compression section, a fuel injection device being selectively actuatable to inject atomized fuel into said combustion chamber body, and a controller in communication with said control valve and said fuel injection device, said controller being adapted for actuating said control valve and said fuel injection device, said method comprising the steps of:

actuating said control valve to reciprocate said piston element from a bottom dead center BDC position to a top dead center TDC position through a stroke "S" beginning immediately after the closure of said exhaust aperture and ending substantially at the top dead center position TDC of said piston element; and actuating said fuel injection device continuously during said stroke "S".

4. A method, as set forth in claim 3, including the steps of:

delivering a control signal from a piston position sensor to the controller in response to the compression chamber piston being at a predetermined location at which said exhaust aperture is closed; and actuating said fuel injector device by said controller in response to receiving said signal.

* * * * *